US009518313B2

(12) United States Patent
Novotny

(10) Patent No.: US 9,518,313 B2
(45) Date of Patent: Dec. 13, 2016

(54) HIGH STRENGTH, HIGH TOUGHNESS STEEL ALLOY

(71) Applicant: CRS Holdings, Inc., Wilmington, DE (US)

(72) Inventor: Paul M. Novotny, Mohnton, PA (US)

(73) Assignee: CRS HOLDINGS, INC., Wilmington, DE (US)

( * ) Notice: Subject to any disclaimer, the term of this patent is extended or adjusted under 35 U.S.C. 154(b) by 342 days.

(21) Appl. No.: 13/645,596

(22) Filed: Oct. 5, 2012

(65) Prior Publication Data

US 2013/0037176 A1 Feb. 14, 2013

Related U.S. Application Data

(63) Continuation of application No. 13/016,606, filed on Jan. 28, 2011, now abandoned, which is a continuation-in-part of application No. 12/488,112, filed on Jun. 19, 2009, now abandoned.

(60) Provisional application No. 61/083,249, filed on Jul. 24, 2008, provisional application No. 61/172,098, filed on Apr. 23, 2009.

(51) Int. Cl.

| | |
|---|---|
| ***C22C 38/42*** | (2006.01) |
| ***C21D 6/00*** | (2006.01) |
| ***C21D 7/13*** | (2006.01) |
| ***C21D 8/00*** | (2006.01) |
| ***C21D 9/00*** | (2006.01) |
| ***C22C 38/00*** | (2006.01) |
| ***C22C 38/04*** | (2006.01) |
| ***C22C 38/34*** | (2006.01) |
| ***C22C 38/44*** | (2006.01) |
| ***C22C 38/46*** | (2006.01) |
| *C21D 1/32* | (2006.01) |

(52) U.S. Cl.

CPC ..... *C22C 38/42* (2013.01); *C21D 6/004* (2013.01); *C21D 7/13* (2013.01); *C21D 8/005* (2013.01); *C21D 9/0068* (2013.01); *C22C 38/002* (2013.01); *C22C 38/04* (2013.01); *C22C 38/34* (2013.01); *C22C 38/44* (2013.01); *C22C 38/46* (2013.01); *C21D 1/32* (2013.01)

(58) Field of Classification Search

CPC ..... C22C 38/42

USPC ..... 148/320, 332–337, 622–624; 420/89–93, 420/104–119, 122–124

See application file for complete search history.

(56) References Cited

U.S. PATENT DOCUMENTS

| | | | |
|---|---|---|---|
| 3,713,905 | A | 1/1973 | Philip et al. |
| 4,729,872 | A | 3/1988 | Kishida et al. |
| 5,972,129 | A | 10/1999 | Beguinot et al. |
| 6,187,261 | B1 | 2/2001 | Fedchun |
| 6,254,696 | B1 | 7/2001 | Ueda |
| 6,426,038 | B1 | 7/2002 | Fedchun |
| 6,426,040 | B1 | 7/2002 | Fedchun |
| 6,699,333 | B1 | 3/2004 | Dubois |
| 7,067,019 | B1 | 6/2006 | Fedchun et al. |
| 7,537,727 | B2 | 5/2009 | Dilmore |
| 2003/0026723 | A1 | 2/2003 | Takayama et al. |
| 2009/0277539 | A1 | 11/2009 | Kimura et al. |
| 2009/0291013 | A1 | 11/2009 | Fedchun |
| 2009/0291014 | A1 | 11/2009 | Vartanov |

FOREIGN PATENT DOCUMENTS

| | | |
|---|---|---|
| EP | 1 101 828 | 5/2001 |
| JP | 4-143253 | 5/1992 |
| JP | 10-287957 | 10/1998 |
| JP | 11-152519 | 6/1999 |
| JP | 2003-105485 | 4/2003 |
| JP | 2008-138241 | 6/2008 |
| WO | 20041067783 | 8/2004 |

OTHER PUBLICATIONS

Oberg et al. 26th Edition Machinery's Handbook. Industrial Press Inc. 2000. p. 456.*

V. Fedchun et al., "Steel with high strength and toughness," Advanced Materials & Processes, Jul. 2006, pp. 33 to 36.

Aerospace Material Specification, "Hydrogen Embrittlement Relief (Baking) of Steel Parts," SAE Aerospace, Nov. 2007.

(Continued)

*Primary Examiner* — Brian Walck

(74) *Attorney, Agent, or Firm* — Dann Dorfman Herrell and Skillman

(57) ABSTRACT

A high strength, high toughness steel alloy is disclosed. The alloy has the following weight percent composition.

| Element | |
|---|---|
| C | 0.30-0.47 |
| Mn | 0.8-1.3 |
| Si | 1.5-2.5 |
| Cr | 1.5-2.5 |
| Ni | 3.0-5.0 |
| Mo + ½ W | 0.7-0.9 |
| Cu | 0.70-0.90 |
| Co | 0.01 max. |
| V + (5/9) × Nb | 0.10-0.25 |
| Ti | 0.005 max. |
| Al | 0.015 max. |
| Fe | Balance |

Included in the balance are the usual impurities found in commercial grades of steel alloys produced for similar use and properties including not more than about 0.01% phosphorus and not more than about 0.001% sulfur. Also disclosed is a hardened and tempered article that has very high strength and fracture toughness. The article is formed from the alloy having the broad weight percent composition set forth above. The alloy article according to this aspect of the invention is further characterized by being tempered at a temperature of about 500° F. to 600° F.

14 Claims, No Drawings

(56) References Cited

OTHER PUBLICATIONS

George A. Roberts et al., "Effect of Alloying Elements on Tempering Characteristics," Tool Steels, Copyright 1980, pp. 219 to 225, Fourth Edition, American Society for Metals, Metals Park, Ohio, USA.

J.R. Kattus, "300 M, Fe UH," Code 1217 Aerospace Structural Materials Handbook, CINDAS/USAF CR DA Handbooks, W. Lafayette, in (Sep. 1987).

* cited by examiner

HIGH STRENGTH, HIGH TOUGHNESS STEEL ALLOY

BACKGROUND OF THE INVENTION

Field of the Invention

This invention relates to high strength, high toughness steel alloys, and in particular, to such an alloy that can be tempered at a significantly higher temperature without significant loss of tensile strength. The invention also relates to a high strength, high toughness, tempered steel article.

Description of the Related Art

Age-hardenable martensitic steels that provide a combination of very high strength and fracture toughness are known. Among the known steels are those described in U.S. Pat. No. 4,076,525 and U.S. Pat. No. 5,087,415. The former is known as AF1410 alloy and the latter is sold under the registered trademark AERMET. The combination of very high strength and toughness provided by those alloys is a result of their compositions which include significant amounts of nickel, cobalt, and molybdenum, elements that are typically among the most expensive alloying elements available. Consequently, those steels are sold at a significant premium compared to other alloys that do not contain such elements.

More recently, a steel alloy has been developed that provides a combination of high strength and high toughness without the need for alloying additions such as cobalt and molybdenum. One such steel is described in U.S. Pat. No. 7,067,019. The steel described in that patent is an air hardening CuNiCr steel that excludes cobalt and molybdenum. In testing, the alloy described in the '019 patent has been shown to provide a tensile strength of about 280 ksi together with a fracture toughness of about 90 ksi √in. The alloy is hardened and tempered to achieve that combination of strength and toughness. The tempering temperature is limited to not more than about 400° F. in order to avoid softening of the alloy and a corresponding loss of strength.

The alloy described in the '019 patent is not a stainless steel and therefore, it must be plated to resist corrosion. Material specifications for aerospace applications of the alloy require that the alloy be heated at 375° F. for at least 23 hours after being plated in order to remove hydrogen adsorbed during the plating process. Hydrogen must be removed because it leads to embrittlement of the alloy and adversely affects the toughness provided by the alloy. Because this alloy is tempered at 400° F., the 23 hour 375° F. post-plating heat treatment results in over-tempering of parts made from the alloy such that a tensile strength of at least 280 ksi cannot be provided. It would be desirable to have a CuNiCr alloy that can be hardened and tempered to provide a tensile strength of at least 280 ksi and a fracture toughness of about 90 ksi √in, and maintain that combination of strength and toughness when heated at about 375° F. for at least 23 hours, subsequent to being hardened and tempered.

SUMMARY OF THE INVENTION

The disadvantages of the known alloys as described above are resolved to a large degree by an alloy according to the present invention. In accordance with one aspect of the present invention, there is provided a high strength, high toughness steel alloy that has the following broad and preferred weight percent compositions.

| Element | Broad | Preferred A | Preferred B | Preferred C |
|---|---|---|---|---|
| C | 0.30-0.55 | 0.37-0.50 | 0.30-0.40 | 0.40-0.47 |
| Mn | 0.6-1.3 | 0.7-0.9 | 0.8-1.3 | 0.8-1.3 |
| Si | 0.9-2.5 | 1.3-2.1 | 1.5-2.5 | 1.5-2.5 |
| Cr | 0.75-2.5 | 1.2-1.5 | 1.5-2.5 | 1.5-2.5 |
| Ni | 3.0-7.0 | 3.7-4.5 | 3.0-4.5 | 4.0-5.0 |
| Mo + ½ W | 0.4-1.3 | 0.5-1.1 | 0.7-0.9 | 0.7-0.9 |
| Cu | 0.5-0.9 | 0.5-0.6 | 0.70-0.90 | 0.70-0.90 |
| Co | 0.01 max. | 0.01 max. | 0.01 max. | 0.01 max. |
| V + (⅔) × Nb | 0.10-1.0 | 0.2-1.0 | 0.10-0.25 | 0.10-0.25 |
| Ti | 0.001 max. | 0.001 max. | 0.005 max. | 0.005 max. |
| Al | | | 0.015 max. | 0.015 max. |
| Fe | Balance | Balance | Balance | Balance |

Included in the balance are the usual impurities found in commercial grades of steel alloys produced for similar use and properties. Among said impurities phosphorus is preferably restricted to not more than about 0.01% and sulfur is preferably restricted to not more than about 0.001%. Within the foregoing weight percent ranges, silicon, copper, and vanadium are balanced such that $$2 \leq (\%\ Si + \%\ Cu)/(\%\ V + (5/9) \times \%\ Nb) \leq 34.$$

The foregoing tabulation is provided as a convenient summary and is not intended to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad or preferred composition can be used with the minimum or maximum for the same element in another preferred or intermediate composition. Moreover, the alloy according to the present invention may comprise, consist essentially of, or consist of the constituent elements described above and throughout this application. Here and throughout this specification the term "percent" or the symbol "%" means percent by weight or mass percent, unless otherwise specified.

In accordance with another aspect of the present invention, there is provided a hardened and tempered steel alloy article that has very high strength and fracture toughness. The article is formed from an alloy having the broad or preferred weight percent composition set forth above. The alloy article according to this aspect of the invention is further characterized by being tempered at a temperature of about 500° F. to 600° F.

DETAILED DESCRIPTION

The alloy according to the present invention contains at least about 0.30% and preferably at least about 0.32% carbon. Carbon contributes to the high strength and hardness capability provided by the alloy. When higher strength and hardness are desired, the alloy preferably contains at least about 0.40% carbon (e.g., Preferred C). Carbon is also beneficial to the temper resistance of this alloy. Too much carbon adversely affects the toughness provided by the alloy. Therefore, carbon is restricted to not more than about 0.55%, better yet to not more than about 0.50%, and preferably to not more than about 0.47%. The inventor has found that when the alloy contains as little as 0.30% carbon, the upper limit for carbon can be restricted to not more than about 0.40% and the alloy can be balanced with respect to its constituents (e.g., Preferred B) to provide a tensile strength of at least 290 ksi.

At least about 0.6%, better yet at least about 0.7%, and preferably at least about 0.8% manganese is present in this alloy primarily to deoxidize the alloy. It has been found that manganese also benefits the high strength provided by the alloy. Thus, when higher strength is desired, the alloy contains at least about 1.0% manganese. If too much manganese is present, then an undesirable amount of retained austenite may result during hardening and quenching such that the high strength provided by the alloy is adversely affected. Therefore, the alloy may contain up to about 1.3% manganese. Otherwise, the alloy contains not more than about 1.2% or not more than about 0.9% manganese.

Silicon benefits the hardenability and temper resistance of this alloy. Therefore, the alloy contains at least about 0.9% silicon and preferably, at least about 1.3% silicon. At least about 1.5% and preferably at least about 1.9% silicon is present in the alloy when higher hardness and strength are needed. Too much silicon adversely affects the hardness, strength, and ductility of the alloy. In order to avoid such adverse effects silicon is restricted to not more than about 2.5% and preferably to not more than about 2.2% or 2.1% in this alloy.

The alloy contains at least about 0.75% chromium because chromium contributes to the good hardenability, high strength, and temper resistance provided by the alloy. Preferably, the alloy contains at least about 1.0%, and better yet at least about 1.2% chromium. Higher strength can be provided when the alloy contains at least about 1.5% and preferably at least about 1.7% chromium. More than about 2.5% chromium in the alloy adversely affects the impact toughness and ductility provided by the alloy. In the high strength embodiments of this alloy chromium is preferably restricted to not more than about 1.9%. Otherwise, chromium is restricted to not more than about 1.5% in this alloy and better yet to not more than about 1.35%.

Nickel is beneficial to the good toughness provided by the alloy according to this invention. Therefore, the alloy contains at least about 3.0% nickel and preferably at least about 3.1% nickel. A preferred embodiment of the alloy (e.g., Preferred A) contains at least about 3.7% nickel. When the alloy is balanced to provide higher strength, it preferably contains at least about 4.0% and better yet at least about 4.6% nickel. The benefit provided by larger amounts of nickel adversely affects the cost of the alloy without providing a significant advantage. In order to limit the upside cost of the alloy, the amount of nickel is restricted to not more than about 7%. Thus, for the highest strength embodiment of the alloy (e.g., Preferred C), up to about 5.0% nickel, preferably up to about 4.9% nickel, can be present. In lower strength embodiments (e.g., Preferred A and Preferred B) the alloy contains not more than about 4.5% nickel.

Molybdenum is a carbide former that is beneficial to the temper resistance provided by this alloy. The presence of molybdenum boosts the tempering temperature of the alloy such that a secondary hardening effect is achieved at about 500° F. Molybdenum also contributes to the strength and fracture toughness provided by the alloy. The benefits provided by molybdenum are realized when the alloy contains at least about 0.4% molybdenum and preferably at least about 0.5% molybdenum. For higher strength, the alloy contains at least about 0.7% molybdenum. Like nickel, molybdenum does not provide an increasing advantage in properties relative to the significant cost increase of adding larger amounts of molybdenum. For that reason, the alloy contains up to about 1.3% molybdenum, better yet not more than about 1.1% molybdenum, preferably not more than about 0.9% molybdenum in the higher strength forms of the alloy (Preferred B and Preferred C). Tungsten may be substituted for some or all of the molybdenum in this alloy. When present, tungsten is substituted for molybdenum on a 2:1 basis.

This alloy preferably contains at least about 0.5% copper which contributes to the hardenability and impact toughness of the alloy. When higher strength is desired, the alloy contains at least about 0.7% copper. Too much copper can result in precipitation of an undesirable amount of free copper in the alloy matrix and adversely affect the fracture toughness of the alloy. Therefore, not more than about 0.9% and preferably not more than about 0.85% copper is present in this alloy. Copper can be limited to about 0.6% max. when very high strength is not needed.

Vanadium contributes to the high strength and good hardenability provided by this alloy. Vanadium is also a carbide former and promotes the formation of carbides that help provide grain refinement in the alloy and that benefit the temper resistance and secondary hardening of the alloy. For those reasons, the alloy preferably contains at least about 0.10% and preferably at least about 0.14% vanadium. Too much vanadium adversely affects the strength of the alloy because of the formation of larger amounts of carbides in the alloy which depletes carbon from the alloy matrix material. Accordingly, the alloy may contain up to about 1.0% vanadium, but preferably contains not more than about 0.35% vanadium. In the higher strength embodiments of the alloy (Preferred B and Preferred C), vanadium is restricted to not more than about 0.25% and preferably to not more than about 0.22%. Niobium can be substituted for some or all of the vanadium in this alloy because like vanadium, niobium combines with carbon to form $M_4C_3$ carbides that benefit the temper resistance and hardenability of the alloy. When present, niobium is substituted for vanadium on 1.8:1 basis.

This alloy may also contain a small amount of calcium up to about 0.005% retained from additions during melting of the alloy to help remove sulfur and thereby benefit the fracture toughness provided by the alloy.

Silicon, copper, vanadium, and when present, niobium are preferably balanced within their above-described weight percent ranges to benefit the novel combination of strength and toughness that characterize this alloy. More specifically, the ratio (% Si+% Cu)/(% V+(5/9)×% Nb) is about 2 to 34. The ratio is preferably about 6-12 for strength levels below about 290 ksi. For strength levels of 290 ksi and above, the alloy is balanced such that the ratio is about 14.5 up to about 34. It is believed that when the amounts of silicon, copper, and vanadium present in the alloy are balanced in accordance with the ratio, the grain boundaries of the alloy are strengthened by preventing brittle phases and tramp elements from forming on the grain boundaries.

The balance of the alloy is essentially iron and the usual impurities found in commercial grades of similar alloys and steels. In this regard, the alloy preferably contains not more than about 0.01%, better yet, not more than about 0.005% phosphorus and not more than about 0.001%, better yet not more than about 0.0005% sulfur. The alloy preferably contains not more than about 0.01% cobalt. Titanium may be present at a residual level of up to about 0.01% from deoxidation additions during melting and is preferably restricted to not more than about 0.005%. Up to about 0.015% aluminum may also be present in the alloy from deoxidation additions during melting.

The alloys according to preferred compositions B and C is balanced to provide very high strength and toughness in the hardened and tempered condition. In this regard, the Preferred B composition is balanced to provide a tensile strength of at least about 290 ksi in combination with good toughness as indicated by a $K_{Ic}$ fracture toughness of at least about 70 √in. In addition, the Preferred C composition is balanced to provide a tensile strength of at least about 310 ksi in combination with a $K_{Ic}$ fracture toughness of at least about 50 √in for applications that require higher strength and good toughness.

No special melting techniques are needed to make the alloy according to this invention. The alloy is preferably vacuum induction melted (VIM) and, when desired as for critical applications, refined using vacuum arc remelting (VAR). The alloy can also be arc melted in air (ARC) if desired. After ARC melting, the alloy may be refined by electroslag remelting (ESR) or VAR.

The alloy of this invention is preferably hot worked from a temperature of up to about 2100° F., preferably at about 1800° F., to form various intermediate product forms such as billets and bars. The alloy is preferably heat treated by austenitizing at about 1585° F. to about 1735° F. for about 1-2 hours. The alloy is then air cooled or oil quenched from the austenitizing temperature. When desired, the alloy can be vacuum heat treated and gas quenched. The alloy is preferably deep chilled to either −100° F. or −320° F. for about 1-8 hours and then warmed in air. The alloy is preferably tempered at about 500° F. for about 2-3 hours and then air cooled. The alloy may be tempered at up to 600° F. when an optimum combination of strength and toughness is not required.

The alloy of the present invention is useful in a wide range of applications. The very high strength and good fracture toughness of the alloy makes it useful for machine tool components and also in structural components for aircraft, including landing gear. The alloy of this invention is also useful for automotive components including, but not limited to, structural members, drive shafts, springs, and crankshafts. It is believed that the alloy also has utility in armor plate, sheet, and bars.

Working Examples

Two 400 lb. heats having the weight percent compositions shown in Table 1 below were prepared for evaluation as follows. Both heats were vacuum induction melted and then cast as

TABLE 1

| Element | Heat 1 | Heat 2 |
|---|---|---|
| C | 0.35 | 0.41 |
| Mn | 1.17 | 1.18 |
| Si | 2.00 | 2.02 |
| P | 0.008 | 0.007 |
| S | <0.0005 | 0.0006 |
| Cr | 1.74 | 1.74 |
| Ni | 3.24 | 4.75 |
| Mo | 0.77 | 0.76 |
| Cu | 0.79 | 0.79 |
| Co | <0.01 | |
| Ti | 0.006 | 0.006 |
| Al | 0.007 | 0.008 |
| N | 0.0032 | 0.0036 |
| O | 0.0010 | <0.0010 |
| V | 0.19 | 0.19 |
| Fe | Bal. | Bal. |

7.5 inch square ingots. The ingots were heated at 2300° F. for a time sufficient to homogenize the alloys. The ingots were then hot worked from a temperature of 1800° F. to 3½ inch×5 inch bars. The bars were then reheated to 1800° F. and a portion of each bar was further hot worked to a cross section of 1½ inches×4⅝ inches. The hot working was carried out in steps with reheating of the intermediate forms as needed. After forging, the bars were allowed to cool to room temperature in air. The cooled bars were each then cut into two pieces at the junction between the two section sizes. The bar pieces were annealed at 1250° F. for 8 hours and then cooled in air.

Standard tensile, Charpy V-notch, and fracture toughness, and hardness test specimens were prepared from the bar pieces with both longitudinal and transverse orientations. The test specimens were heat treated as follows for testing. The specimens of Heat 1 were austenitized in a vacuum furnace at 1685° F. for 1.5 hours and then gas quenched. The as-quenched specimens were deep chilled at −100° F. for 8 hours and then warmed to room temperature in air. Finally, the specimens were tempered at 500° F. for 2 hours and then cooled in air from the tempering temperature. The specimens of Heat 2 were austenitized in a vacuum furnace at 1735° F. for 2 hours and then gas quenched. The as-quenched specimens were deep chilled at −100° F. for 8 hours and then warmed to room temperature in air. Finally, the specimens were tempered at 500° F. for 2 hours and then cooled in air from the tempering temperature.

The results of room temperature tensile, Charpy V-notch, and $K_{Ic}$ fracture toughness testing are shown in Tables 2A and 2B below including the 0.2% offset yield strength (Y.S) and ultimate tensile strength (U.T.S.) in ksi, the percent elongation (% El.) and percent reduction in area (% R.A.), the Charpy V-notch impact strength (CVN) in ft-lbs, the rising step load $K_{Ic}$ fracture toughness in ksi√in, and Rockwell C-scale hardness (HRC). The rising step load fracture toughness test was conducted in accordance with ASTM Standard Test Procedures E399, E812, and E1290. Table 2A shows the results for Heat 1 and Table 2B shows the results for Heat 2.

TABLE 2A

| Orientation | Sample | Y.S. | U.T.S. | % El. | % R.A. | CVN | $K_{Ic}$ | HRC |
|---|---|---|---|---|---|---|---|---|
| Longitudinal | 1 | 235.8 | 297.2 | 11.0 | 44.9 | 23.1 | 73.6 | |
| | 2 | 235.7 | 296.8 | 12.7 | 50.7 | 22.0 | 74.8 | |
| | Average | 235.7 | 297.0 | 11.9 | 47.8 | 22.6 | 74.2 | 55.1 |
| Transverse | 1 | * | * | * | * | 22.3 | 75.0 | |
| | 2 | 233.8 | 296.5 | 11.1 | 40.8 | 21.6 | 73.3 | |
| | Average | 233.8 | 296.5 | 11.1 | 40.8 | 22.0 | 74.2 | 55.2 |

* = Not Included in Averages - Cause of low properties not known.

TABLE 2B

| Orientation | Sample | Y.S. | U.T.S. | % El. | % R.A. | CVN | $K_{Ic}$ | HRC |
|---|---|---|---|---|---|---|---|---|
| Longitudinal | 1A | 244.2 | 312.7 | 10.9 | 44.1 | 19.2 | 56.8 | |
| | 2A | 244.5 | 312.6 | 11.9 | 48.8 | 16.8 | 55.7 | 56.3 |
| Longitudinal | 1B | 246.9 | 313.1 | 10.7 | 44.1 | 16.8 | 57.5 | |
| | 2B | 245.0 | 312.1 | 11.6 | 50.4 | 17.9 | 59.3 | 56.2 |
| | Average | 245.1 | 312.6 | 11.3 | 46.9 | 17.7 | 57.3 | 56.3 |
| Transverse | 1A | 243.9 | 311.7 | 10.8 | 42.2 | 14.1 | 55.2 | |
| | 2A | ** | ** | ** | ** | 14.3 | 57.6 | 56.0 |
| Transverse | 1B | 246.7 | 312.2 | 10.6 | 41.9 | 15.4 | 56.4 | |
| | 2B | 246.5 | 312.2 | 10.9 | 43.4 | 15.0 | 56.9 | 56.2 |
| | Average | 245.7 | 312.1 | 10.8 | 42.5 | 14.7 | 56.5 | 56.1 |

** = Tensile specimen was cracked

The terms and expressions which are employed herein are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A steel alloy consisting essentially of, in weight percent, about:

| | |
|---|---|
| C | 0.30-0.40 |
| Mn | 0.8-1.3 |
| Si | 1.9-2.5 |
| Cr | 1.5-2.5 |
| Ni | 3.0-4.5 |
| Mo + ½ W | 0.7-0.9 |
| Cu | 0.70-0.90 |
| Co | 0.01 max. |
| V + (5/9) × Nb | 0.10-0.25 |
| Ti | 0.005 max. |
| Al | 0.015 max. |

the balance being iron and usual impurities wherein phosphorus is restricted to about 0.01% max. and sulfur is restricted to not more than about 0.001% max., and wherein $$14.5 \leq (\%\ Si + \%\ Cu)/(\%\ V + (5/9) \times \%\ Nb) \leq 34.$$

2. The alloy claimed in claim 1 which contains not more than about 1.2% manganese.

3. The alloy claimed in claim 1 which contains at least about 1.0% manganese.

4. The alloy claimed in claim 1 which contains at least about 1.7% chromium.

5. The alloy claimed in claim 1 which contains at least about 3.1% nickel.

6. The alloy as claimed in claim 1 which contains not more than about 2.2% silicon.

7. The alloy as claimed in claim 1 which contains at least about 0.32% carbon.

8. The alloy as claimed in claim 1 which contains not more than about 1.2% manganese.

9. The alloy as claimed in claim 1 which contains not more than about 0.85% copper.

10. The alloy as claimed in claim 6 wherein % V+(5/9)×% Nb is at least about 0.14%.

11. The alloy as claimed in claim 1 wherein % V+(5/9)×% Nb is not more than about 0.22%.

12. A quenched and tempered steel article formed from the steel alloy claimed in claim 1 wherein said steel article provides a room temperature tensile strength of at least about 290 ksi in combination with a fracture toughness ($K_{Ic}$) of at least about 70 ksi√in.

13. The quenched and tempered steel article claimed in claim 12 wherein the article comprises a structural component for an aircraft.

14. The quenched and tempered steel article claimed in claim 13 wherein the structural component comprises landing gear.

* * * * *